US005207318A

United States Patent [19]

Roland et al.

[11] Patent Number: 5,207,318

[45] Date of Patent: May 4, 1993

[54] PLUNGER SWITCH

[75] Inventors: Leonard A. Roland, Burbank; David T. Ko, Thousand Oaks; Michael T. Long, Rancho Palos Verdes, all of Calif.

[73] Assignee: Dynatech Microwave Technology, Inc., Calabasas, Calif.

[21] Appl. No.: 737,201

[22] Filed: Jul. 29, 1991

[51] Int. Cl.[5] ..... H01H 13/14

[52] U.S. Cl. ..... 200/534; 200/5 R; 200/16 A; 200/16 B; 200/530; 200/243

[58] Field of Search ..... 200/5 R, 16 A, 16 B, 200/530, 534, 243, 292, 275, 526, 527, 528, 504; 333/105, 262

[56] References Cited

U.S. PATENT DOCUMENTS

| | | | |
|---|---|---|---|
| 1,556,828 | 5/1919 | Wyman | 200/11 E |
| 2,758,169 | 8/1956 | Weide | 200/243 X |
| 2,759,152 | 8/1956 | Charles | 200/504 X |
| 2,784,379 | 10/1952 | Schunemann | 333/105 |
| 2,858,382 | 5/1957 | Lehman | 200/5 R |
| 3,036,282 | 1/1960 | Lanctot | 333/262 |
| 3,104,300 | 9/1963 | Hutt | 200/530 |
| 3,142,187 | 7/1964 | Kane et al. | 200/16 A |
| 3,182,270 | 11/1962 | Horton | 333/105 |
| 3,648,000 | 3/1972 | Thompson | 200/53 |
| 3,739,306 | 6/1973 | Sladek | 333/105 |
| 4,063,054 | 12/1977 | Hirata | 200/508 |
| 4,079,220 | 3/1978 | Wagner et al. | 200/530 X |
| 4,206,332 | 6/1980 | Veenendaal | 200/504 |
| 4,633,118 | 12/1986 | Kosugi | 310/328 |
| 4,652,840 | 3/1987 | Kosugi | 333/105 |
| 4,908,588 | 3/1990 | Hoffman et al. | 333/105 |
| 4,950,846 | 8/1990 | Pollard | 200/243 X |
| 4,967,174 | 10/1990 | Yee et al. | 335/5 |

*Primary Examiner*—Henry J. Recla
*Assistant Examiner*—Glenn T. Barrett
*Attorney, Agent, or Firm*—Arthur Freilich; Robert D. Hornbaker; Leon D. Rosen

[57] ABSTRACT

A switch is described that includes a plunger (20, FIG. 1) moveable between up and down position and having upper contacts (22, 24) and lower contacts (26, 28). When the plunger is moved to a down position, opposite ends of the upper contact (22) move down against first and second terminals (12, 14) to interconnect them. When the plunger is moved to an up position, opposite ends of the lower contact (26) move up against the first terminal (12) and a third terminal (16) to interconnect them. The plunger can move within a hole in a circuit board and carry two upper and two lower contacts to connect four terminals in two different ways. Each terminal can include upper and lower terminal pads (120, 122, FIG. 5) lying respectively on upper and lower surfaces of the circuit board and interconnected through plated-through holes (124) in the board.

8 Claims, 2 Drawing Sheets

FIG. 5
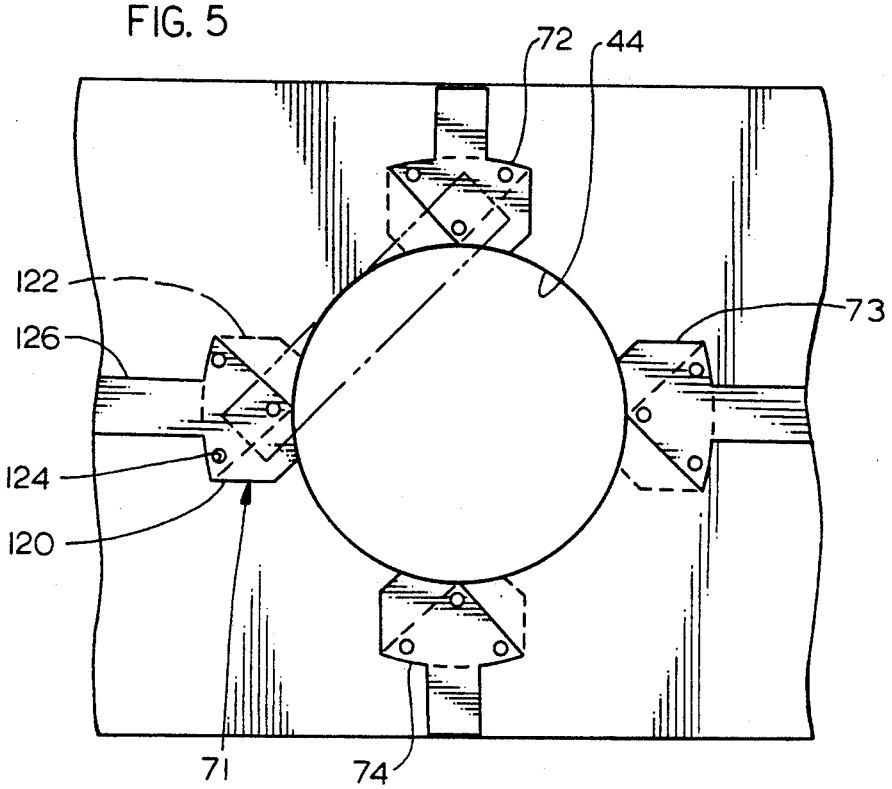
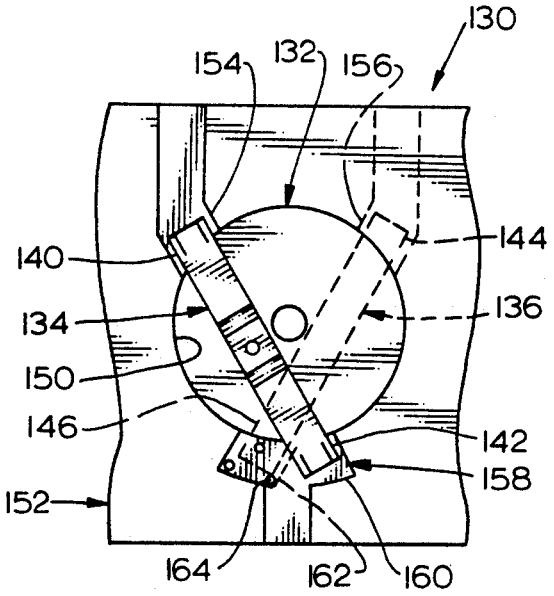
FIG. 6
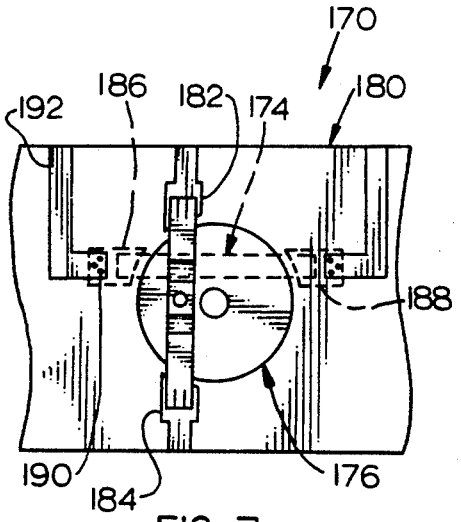
FIG. 7

PLUNGER SWITCH

BACKGROUND OF THE INVENTION

Switches that can interconnect different pairs of terminals are useful in a variety of applications. One radio frequency application is where the transmitter of a transceiver can be connected to an antenna or to a dissipating load, while the receiver is connected respectively to the load or to the antenna, this being accomplished through a double pole, double throw switch. It is often preferable that such a switch be operated by a simple solenoid which has two different states. A relatively simple switch which could make such multiple connections would be of considerable value.

SUMMARY OF THE INVENTION

In accordance with one embodiment of the present invention, a switch is provided that is of relatively simple construction but which can make complicated interconnections between terminals. The switch includes a plunger that is moveable between up and down positions relative to a frame, the plunger carrying upper and lower contacts that each have opposite ends. The frame has at least three terminals that are positioned so that when the plunger is moved to the down position, the opposite ends of the upper contact move down against two terminals of a first pair of terminals on the frame to interconnect them. When the plunger is moved to an up position, opposite ends of the lower contact move against two terminals of a second pair of terminals on the frame to interconnect them.

The terminals can be arranged on a circuit board, with each terminal having an upper pad on the upper surface of the board and a lower pad on the lower surface of the board, and with the pads interconnected as through plated-through holes in the board.

The novel features of the invention are set forth with particularity in the appended claims. The invention will be best understood from the following description when read in conjunction with the accompanying drawings.

BRIEF DESCRIPTION OF THE DRAWINGS

FIG. 5 is an enlarged partial plan view of the circuit board of the switch of FIG. 3.

FIG. 6 is a partial plan view of a single-pole double-throw switch constructed in accordance with another embodiment of the invention.

FIG. 7 is a partial plan view of a switch constructed in accordance with another embodiment of the invention.

DESCRIPTION OF THE PREFERRED EMBODIMENTS

Figure 1:
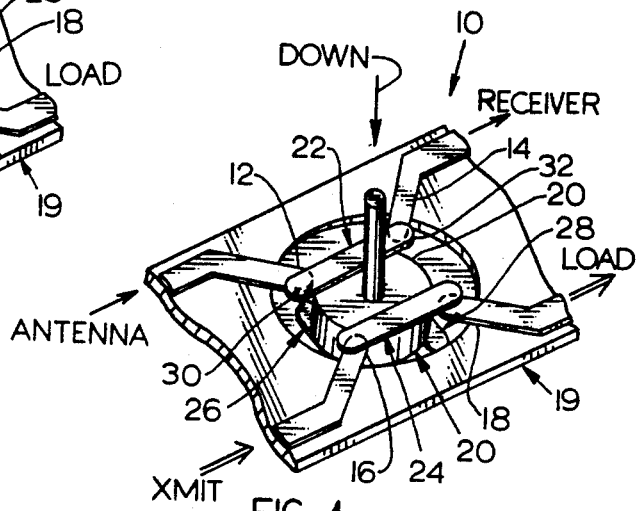
FIG. 1 is a partial isometric view of a double-pole double-throw switch constructed in accordance with one embodiment of the present invention, with the plunger in a down position.

FIG. 1 is an illustration of a simplified switch 10 with four terminals 12–18 mounted on a circuit board frame 19, which enables the terminals to be interconnected in two different ways. The switch includes a plunger 20 that can move up and down between a down position shown in FIG. 1 and an up position shown in FIG. 2. The plunger includes first and second upper contacts 22, 24 and first and second lower contacts 26, 28. Each contact has first and second opposite ends 30, 32. When the plunger is in the down position shown in FIG. 1, the opposite ends of the first upper contact 22 engage the first and second terminals 12, 14 to interconnect them. At the same time, the second upper contact 24 interconnects the third and fourth terminals 16, 18. When the plunger is moved up to the position shown in FIG. 2, the first lower contact 26 interconnects the first and third terminals 12, 16. Also, the second lower contact 28 interconnects the second and fourth terminals 14, 18. Thus, by moving the plunger between its up and down positions, the switch is able to connect the four terminals in two different ways.

Applicant uses terms such as "up" and "down" to aid in describing the apparatus as shown in the drawings. However, it should be understood that the switch and its parts can be used in any orientation with respect to gravity.

Figure 2:
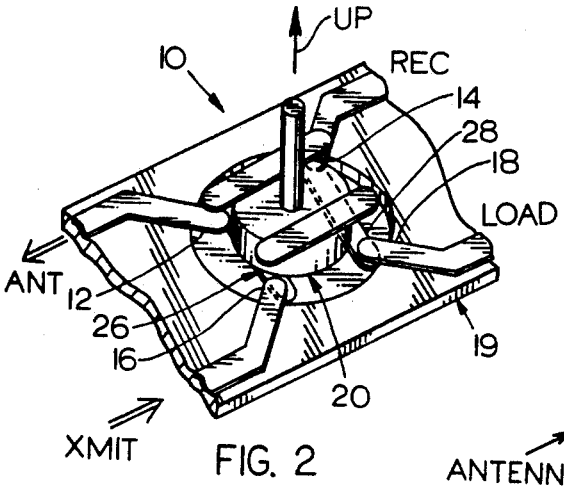
FIG. 2 is a view similar to that of FIG. 1, but with the plunger in an up position.

One example in which the switch of FIGS. 1 and 2 is useful is in a transceiver, to connect either the transmitter or the receiver to an antenna. In the switch position of FIG. 1, where an antenna is connected to the first terminal 12 and a receiver is connected to the second terminal 14, the plunger in the down position connects the antenna and receiver. At the same time, a transmitter connected to the third terminal 16 is connected to a dissipating load that is connected to the fourth terminal 18. When the plunger is moved up to the up position shown in FIG. 2, the antenna is connected to the receiver, while the receiver is connected to the load.

In each position of the plunger 20, the opposite ends of a contact such as 22 engages a pair of contacts such as the pair 12, 14 or the pair 12, 16. Thus, the same terminal 12 can lie in two different pairs.

Figure 3:
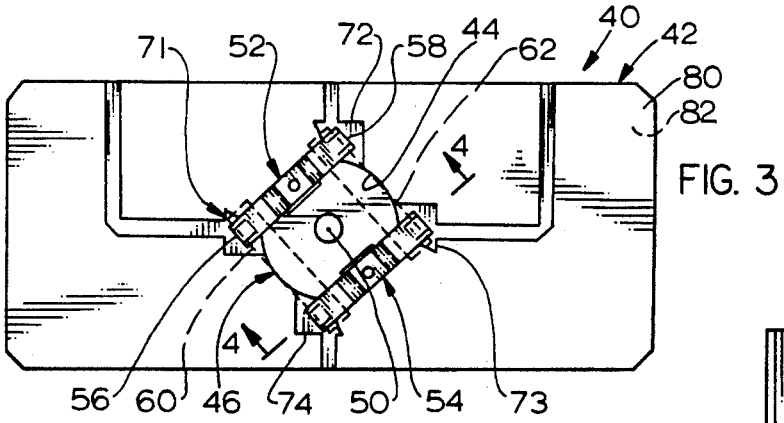
FIG. 3 is a partial plan view of a double-pole double-throw switch constructed in accordance with another embodiment of the invention.
Figure 4:
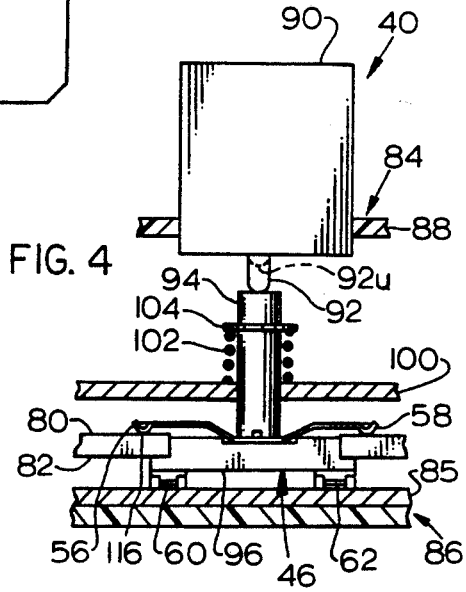
FIG. 4 is a view taken on the line 4—4 of FIG. 3, with the plunger in a down position, and showing additional parts of the switch.

FIGS. 3–5 illustrate another switch 40 that is largely similar in principle to the switch of FIG. 1, but which is more adapted to fabrication for reliable operation. As shown in FIG. 3, the switch includes a frame in the form of a circuit board 42 having a plunger-receiving hole 44. A plunger 46 lies in the hole. When the plane of the circuit board is horizontal, the plunger is moveable up and down along a vertical axis 50. The plunger holds first and second upper contacts 52, 54 that each has opposite ends 56, 58. The plunger also has first and second lower contacts 60, 62 lying at a lower level than the upper contacts. The circuit board has four terminals 71–74 spaced about its plunger-receiving hole. Each terminal has upper and lower portions in the form of pads lying on the upper and lower surfaces or faces 80, 82 of the circuit board.

When the plunger is in a down position, the first upper contact 52 connects the first and second terminals 71, 72; also the second upper contact 54 connects the third and fourth terminals 73, 74. When the plunger is in an up position, the first lower contact 60 connects the first and fourth terminals 71, 74; also the second lower contact 62 connects the second and third terminals 72, 73.

Figure 4A:
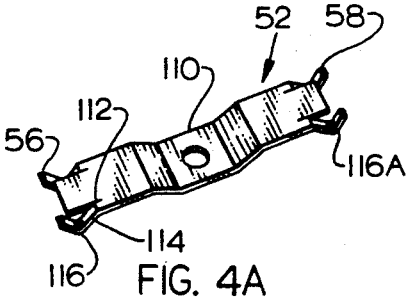
FIG. 4A is an isometric view of one of the contacts of the switch of FIG. 3.

FIG. 4 illustrate additional details of the switch 40, showing that it includes a frame or housing 84 with a lower part 86 lying under the plunger and circuit board, and with a top part 88 supporting a solenoid 90. The circuit board is stationary, and can be considered to be part of the housing. The solenoid has a rod or armature 92 which can move up and down as the solenoid is respectively deenergized and energized. The bottom of the armature bears against the top of a shaft 94 that is part of the plunger 46, and that extends upwardly from a plate-like base portion 96 of the plunger on which the contacts are mounted. An upper part 100 of the housing slidably supports the plunger. A spring 102 lies between a snap ring 104 on the plunger shaft and the upper housing part 100 to urge the plunger upwardly to its up position. When the solenoid is energized, its armature moves downwardly from the position 92*u* to the position 92. It is possible to have the plunger manually depressed, although the use of a solenoid is usually preferable. As shown in FIG. 4A each contact such as 52 has a middle part 110 that is captured on the base portion of the plunger, with each end 56, 58 of the contact having a pair of slits 112 forming small fingers 114 that are bent and that have contact points 116 which engage the terminals. The opposite ends of the contact have spaced contact points 116, 116A. The geometry is adjusted to approximate the characteristic impedance of the system when the switch is used to switch radio frequency or microwave signals.

When the plunger moves down to the position in FIG. 4, the lower contacts 60, 62 engage a plate 85 of the lower housing part. The plate 85 helps stop the downward movement of the plunger so there is not excess force on the ends 56, 58 of the upper contacts. It also would be possible to have a stop that directly engages the plunger. The plate 85 is electrically grounded (at a substantially constant potential) to isolate the contacts from each other, which can occur at high frequencies. The upper housing part 100 comprises a grounded plate that helps stop upward plunger movement and that grounds the upper contacts in the up position of the plunger.

The relationship between the heights of the contacts and terminals can be selected so the upper contacts break engagement with the upper terminal pads before the lower contacts first engage the lower terminal pads. Alternately, the switch can be constructed so the upper contacts remain in engagement with the upper terminal pads for a brief period after the lower contacts first engage the lower terminal pads. Of course, the same relationships can be provided as to the time that the lower contacts break engagement with the lower terminal pads and the upper contacts first engage the upper terminal pads.

FIG. 5 shows details of the portion of the circuit board surrounding the plunger-receiving hole 44. Each terminal such as the first terminal 71 includes upper and lower terminal pads 120, 122 lying on the upper and lower surfaces of the circuit board. The circuit board has three plated-through holes 124 where the upper and lower pads are interconnected with substantially no resistance (much less than one ohm) or other impedance between them. This may be compared to different terminals such as 71 and 72 which are separate in that there is a large resistance or other impedance between them (which may be millions of ohms). A lead 126, whose dimensions are closely controlled so as to match the characteristic impedance of a connected radio or microwave system, extends from the upper pad 120. In a switch that applicant has constructed, each lead extended to the center conductor of a coaxial cable connecter. The upper and lower terminal pads 120, 122 are mirror images of each other when viewed as seen in FIG. 5, so each pad is positioned to engage the ends of a corresponding contact. The pads are of the shape shown to minimize cross talk between different ones of the four terminals 71–74.

FIG. 6 illustrates another switch 130 of a single-pole double-throw configuration. The switch has a plunger 132 and circuit board 152 that are the same as that of FIGS. 3–5, except that the number and placement of the contacts and terminals are different. The plunger 132 supports an upper or first contact 134 and a lower or second contact 136 mounted respectively on the upper and lower surfaces of the base portion of the plunger. The upper contact has first and second opposite ends 140, 142 and the lower contact has first and second ends 144, 146. The plunger is moveable between up and down positions within a hole 150 of the circuit board 152. The circuit board has three terminals 154, 156, and 158 surrounding the plunger-receiving hole. The first terminal 154 includes a conductive pad lying only on the upper surface of the board, while the second terminal 156 has a conductive pad on only the lower surface of the board. The third terminal 158 has conductive pads lying on both the upper and lower board surfaces, with the upper and lower pads 160, 162 connected by plated-through holes 164 in the board. When the plunger is in the down position, the upper contact 134 connects the first and third terminals 154, 158. When the plunger is the up position, the lower contact 136 connects the second and third terminals 156, 158.

FIG. 7 is a plan view of another switch 170 that is largely similar to that of FIG. 3, except that the switch 170 has only one upper contact 172 and one lower contact 174, both mounted on a plunger 176 that can move between up and down positions. The plunger moves within a hole in a circuit board 180 which has four terminals including a pair of upper terminals 182, 184 mounted on the upper surface of the board and a pair of lower terminals 186, 188 mounted on the lower surface of the board. All terminals connect to conductors lying on the upper surface of the board, with the lower terminal connected through plated-through hole 190 to conductors 192 on the upper surface of the board. In the down position of the plunger, its upper contact connects only the two upper terminals 182, 184. In the up position of the plunger, it connects only the lower two terminals 186, 188. It should be noted that while the contacts illustrated are straight, in the shape of an "I", it is also possible to have the contacts curved or angled as in the shape of an "L".

Thus, the invention provides switches that can be constructed at low cost and which can connect multiple terminals in various configurations. The switch includes a plunger moveable between up and down positions and carrying at least one upper contact and one lower contact. The plunger moves relative to a frame that carries a plurality of terminals that can be interconnected by the contacts. When the plunger is in the down position, the opposite ends of one of its contacts engages a first pair of terminals while when the plunger is in the up position, another of its contacts engages another pair of terminals. While the examples given above shown the plunger slidably moveable up and down, it is also possible to mount the plunger at the end of a pivoting arm, in which case it moves along an arc between its upper and lower positions. While the above examples show a frame formed by a single circuit board with all terminals thereon, it is also possible to form the frame with two spaced circuit boards containing terminals, with the plunger engaging terminals on a first board in its down position, and engaging terminals on the second board in its up position.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A double pole, double throw switch comprising:

a frame;

a plunger moveable between up and down positions relative to said frame;

first, second, third, and fourth contacts mounted on said plunger, each contact having first and second opposite ends with the ends of each contact being at least partially horizontally spaced, with the ends of said first and third contacts lying at a higher level than the ends of said second and fourth contacts;

first, second, third, and fourth separate terminals mounted on said frame, with said terminals positioned so that in said plunger down position the opposite ends of said first contact respectively engage said first and second terminals, and the opposite ends of said third contact respectively engage said third and fourth terminals, and in said plunger up position the opposite ends of said second contact respectively engage said first and fourth terminals, and the opposite ends of said fourth contact respectively engage said second and third terminals.

2. A switch comprising:

a frame;

a plunger moveable between up and down positions relative to said frame;

first and second contacts mounted on said plunger, each contact having first and second ends with the ends of each contact being at least partially horizontally spaced and with the ends of one of said contacts lying at a higher level than the ends of another of said contacts;

at least three separate terminals mounted on said frame, with said terminals positioned so said first and second ends of said first contact engage a first pair of said terminals when said plunger is in said down position, and so said first and second ends of said second contact engage a second pair of said terminals when said plunger is in said up position;

said frame includes a circuit board with upper and lower faces, and at least one of said terminals includes a pair of terminal pads with one pad lying on said upper face and the other lying on said lower face and electrically connected to the pad on said upper face.

3. The switch described in claim 2 wherein:

said at least three terminals includes four separate terminals, each terminal having a pair of terminal pads with one on said upper face and the other on the said lower face and electrically connected to the pad on said upper face.

4. A switch comprising:

a plunger that is moveable between up and down positions;

a pair of contacts mounted on said plunger including a first upper contact and a first lower contact, each contact having a pair of spaced contact points;

a frame having a plurality of terminals including first, second, and third terminals which are arranged so said spaced contact points of said first upper contact respectively engage said first and second terminals in said down position of said plunger, and said spaced contact points of said second contact engage said first and third terminals in said up position of said plunger;

said frame comprises a circuit board with a plunger-receiving hole and which has upper and lower faces, and said first terminal includes conductive pads lying on both said upper and lower board faces with said pads being connected together.

5. A switch comprising:

a plunger that is moveable between up and down positions;

a pair of contacts mounted on said plunger including an upper contact and a lower contact, each contact having a pair of spaced contact points;

a frame, and a plurality of terminals mounted on said frame including at least first, second, and third terminals, which are arranged so said spaced contact points of said upper contact respectively engage a pair of said terminals in said down position of said plunger, and said spaced contact points of said lower contact engage a pair of said terminals in said up position of said plunger, said terminals being positioned so a location on each that engages one of said contact points lies at a height between said contact points of said upper and lower contacts;

said frame includes upper and lower parts that lie respectively above and below said contacts in all plunger positions, with said upper and lower frame parts each being devoid of a plurality of separate terminals, said upper and lower frame parts being positioned so said upper and lower contacts move into engagement with said upper and lower frame parts as said plunger moves respectively upwardly and downwardly.

6. The switch described in claim 5 wherein:

said upper and lower frame parts are electrically grounded.

7. A switch comprising:

a plunger that is moveable between up and down positions;

a pair of contacts mounted on said plunger including a first contact and a second contact, each contact having a pair of spaced contact points;

a frame having a plurality of terminals including first, second, third, and fourth terminals which are arranged so said spaced contact points of said first contact engage a first pair of said terminals in said down position of said plunger, and said spaced contact points of said second contact engage a second pair of said terminals in said up position of said plunger;

said frame comprises a circuit board with a plunger-receiving hole and which has upper and lower faces, and said first terminal includes conductive pads lying on both said upper and lower board faces with said pads being connected together.

8. A switch comprising:

a plunger that is moveable between up and down positions;

a pair of contacts mounted on said plunger including a first contact and a second contact, each contact having a pair of spaced contact points;

a frame that has a board with upper and lower surfaces and that lies at a height between said upper and lower contacts in both said up and down positions of said plunger, said frame also having a plurality of terminals supported on said board including at least first, second, and third terminals, with at least two of said terminals having portions on said upper board face and at least two of said terminals having portions on said lower board face, with said terminal portions arranged so said spaced contact points of said first contact respectively engage a first pair of said terminal portions in said down position of said plunger, and said spaced contact points of said second contact engage a second pair of said terminal portions in said up position of said plunger.

* * * * *